United States Patent [19]

Okauchi et al.

[11] 4,232,118

[45] Nov. 4, 1980

[54] LIGHT-SENSITIVE SILVER HALIDE PHOTOGRAPHIC MATERIAL

[75] Inventors: Ken Okauchi; Takeo Koitabashi; Noboru Fujimori, all of Hino, Japan

[73] Assignee: Konishiroku Photo Industry Co., Ltd., Tokyo, Japan

[21] Appl. No.: 16,546

[22] Filed: Mar. 1, 1979

[30] Foreign Application Priority Data

Mar. 10, 1978 [JP] Japan ..... 53/26528

[51] Int. Cl.[3] ..... G03C 1/14

[52] U.S. Cl. ..... 430/574; 430/550; 430/551; 430/614

[58] Field of Search ..... 96/67, 109, 53, 72, 96/95, 96; 430/574, 550, 551, 614

[56] References Cited

U.S. PATENT DOCUMENTS

| | | | |
|---|---|---|---|
| 3,615,633 | 10/1971 | Brooks | 96/126 |
| 3,804,633 | 4/1974 | Sakamoto et al. | 96/109 |
| 3,976,492 | 8/1976 | Hinata et al. | 430/574 |
| 3,986,878 | 10/1976 | Hinata et al. | 430/574 |
| 3,988,155 | 10/1976 | Hinata et al. | 430/574 |
| 4,110,116 | 8/1978 | Beretta et al. | 96/138 |

FOREIGN PATENT DOCUMENTS

| | | | |
|---|---|---|---|
| 660408 | 11/1951 | United Kingdom | 96/67 |

*Primary Examiner*—Travis Brown
*Attorney, Agent, or Firm*—Bierman & Bierman

[57] ABSTRACT

A photographic material having a light-sensitive silver halide emulsion layer containing a mixture of monomethinecyanine dyes is disclosed. The mixture is particularly suitable for minimizing fog in the finished product.

7 Claims, No Drawings

LIGHT-SENSITIVE SILVER HALIDE PHOTOGRAPHIC MATERIAL

This application claims the priority of Japanese 26528/78, filed Mar. 10, 1978.

This invention relates to a light-sensitive silver halide photographic material, particularly to a light-sensitive silver halide photographic material which is stable, and less in the formation of fog.

Extensive efforts have heretofore been made with regard to stabilization of photographic characteristics so that a light-sensitive silver halide photographic material may be able to maintain always definite photographic efficiency without being affected by any difference among the preparation lots or processing lots thereof, and during preservation of the products. Among various photographic characteristics, especially formation of fog is one of the most undesirable elements and there have been a number of proposals to inhibit formation of fog, achieving thereby stabilization of photographic properties. In particular, recently, with a view to effecting the processing rapidly, processing at a high temperature has become practical. Thus, there has been increased a further need for inhibiting formation of fog occuring in such high temperature processing, to attain stabilized photographic characteristics.

As a fog inhibitor, various heterocyclic compounds have heretofore been known to be effective and among them, those containing mercapto group have been known to possess particular fog inhibiting action. With regard to these prior arts, a detailed explanation will be found in C. E. K. Mees and T. H. James', The Theory of the Photographic Process, 3rd edition, page 344–346. Compounds containing mercapto group as known heretofore, however, have a serious drawback that although they show particular fog inhibiting effect, they cause at the same time reduction in the light-sensitivity (desensitization). Further, although compounds of azaindene series are good fog inhibitors causing not so much reduction in the light-sensitivity and having moderate stabilizing effect, they have a drawback that they are not so much effective to inhibit formation of fog during the processing at a high temperature. As apparent from the above, every one of various known fog inhibitors has a certain drawback and no satisfactory result can be obtained therefrom.

The present invention was established with a view to dissolving such problems and thus the first object of the present invention resides in the proposal of a light-sensitive silver halide photographic material inhibited in fogging and stabilized, without causing at the same time any desensitization.

The second object is to provide a light-sensitive silver halide photographic material causing no formation of fog even during the rapid processing at a high temperature.

The third object is to provide a light-sensitive silver halide photographic material causing less formation of fog during storage for a long time after the preparation of said photographic material.

After the researches for achieving the above-mentioned objects, the inventors found that the afore-mentioned problems could be improved when at least one of the monomethinecyanine dyes of the general formula I as given below and at least one of the monomethinecyanine dye of the general formula II as given below are included in a constructive layer of the light-sensitive silver halide photographic materials, and thus established the present invention. Further, the inventors found that when a compound of the general formula III as given below is used in conjunction with the compounds of the general formulae I and II, the afore-mentioned problems could further be improved and thus completed the present invention.

According to the present invention, it is possible to obtain such light-sensitive silver halide photographic material as having the following excellent effects:

(1) There can be obtained a stable, light-sensitive silver halide photographic material in which fog is effectively inhibited without causing any desensitization but rather causing sensitization.

(2) Formation of fog is less, even during the rapid processing at a hight temperature.

(3) Less formation of fog or reduction in the light-sensitivity is caused even during the storage under a high temperature and high humidity.

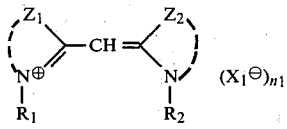

wherein $Z_1$ represents a group of non-metal atoms required to complete, together with the nitrogen atom a 5-membered oxygen-containing heterocyclic residue such as oxazole, benzoxazole, naphthoxazole or the like; $Z_2$ represents a group of non-metal atoms required to complete, together with the nitrogen atom, a 5-membered heterocyclic residue containing an oxygen, sulfur or selenium atom such as oxazole, benzoxazole, naphthoxazole, thiazole, benzothiazole, naphthothiazole, selenazole, benzoselenazole, naphthoselenazole or the like; $R_1$ and $R_2$ each represent aliphatic group (preferably its number of carbon atom is 2 to 4), at least one of them containing a sulfo or carboxyl group; $X_1^{\theta}$ represents an anion and $n_1$ represents a number of 0 or 1 but when the compound forms an intramolecular salt, $n_1$ is 0.

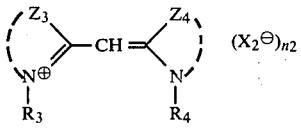

General Formula II wherein $Z_3$ and $Z_4$ each represent a group required to complete, together with the nitrogen atom, a 5-membered heterocyclic residue containing a sulfur or selenium atom such as thiazole, benzothiazole, naphthothiazole, selenazole, benzoselenazole, naphthoselenazole or the like; $R_3$ and $R_4$ each represent aliphatic group (preferably its number of carbon atom is 2 to 4), at least one of them containing a sulfo or carboxyl group; $X_2^{\theta}$ represents an anion and $n_2$ represents a number of 0 or 1, but when the compound forms an intramolecular salt, $n_2$ is 0.

General formula III

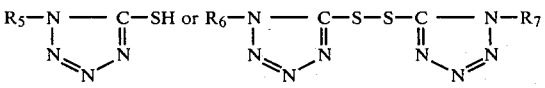

wherein $R_5$, $R_6$ and $R_7$ each represent a hydrogen atom, alkyl, alkenyl, aryl or aralkyl group. Preferable Example of the group represented by $R_5$, $R_6$ or $R_7$ include an alkyl group whose number of carbon atoms is 1 to 20, an alkyl, a phenyl or naphthyl group which may include a alkyl, halogen atom, alkoxy as a substituents therein.

The compounds of the above general formulae I and II are sensitizing dyes well-known as the monomethinecyanine dye and can readily be synthesized according to the process as disclosed in British Pat. No. 660,408 or U.S. Pat. No. 3,149,105. Further, as substituents which may be included at each of the heterocyclic residue represented by $Z_1$, $Z_2$, $Z_3$ or $Z_4$, an alkyl, alkoxy, halogen, carboxylalkyl, trifluoromethyl, hydroxy or aryl group is included. Furthermore, preferable compounds of those of the general formula I comprise both nuclei which are benzoxazoles and/or naphthoxazoles and preferable compounds of these of the general formula II comprise both nuclei which are benzothiazoles, naphthothiazoles, benzoselenazoles and/or naphthoselenazoles. Preferable compounds of those of the general formula III are those having a mercapto group.

Typical examples of compounds of the general formulae I, II and III, utilizable in the present invention will be exemplified below, but compounds used in this invention cannot be limited only to these compounds.

Compounds of the general formula I

I - 1

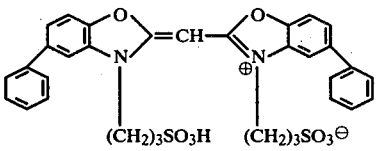

I - 2

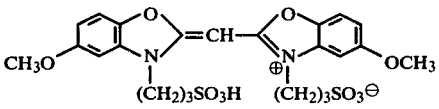

I - 3

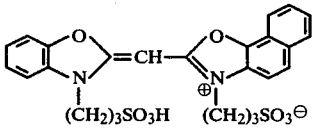

I - 4

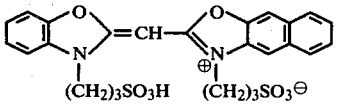

I - 5

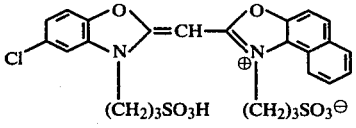

I - 6

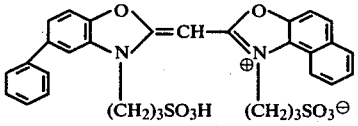

I - 7

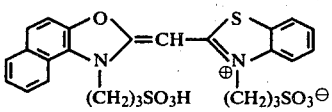

I - 8

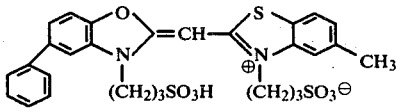

-continued

I - 9

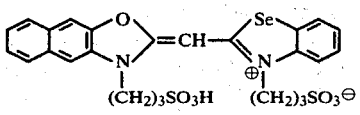

I - 10

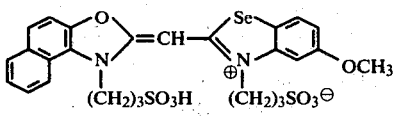

I - 11

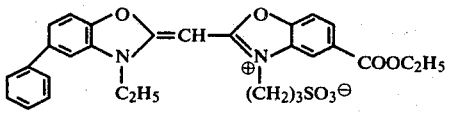

I - 12

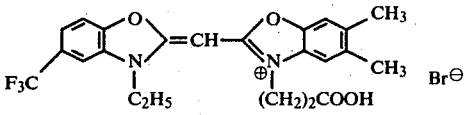

I - 13

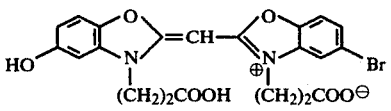

I - 14

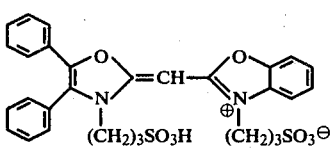

Compounds of the general formula II

II - 1

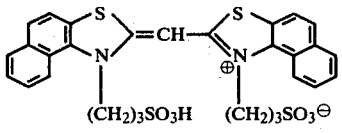

II - 2

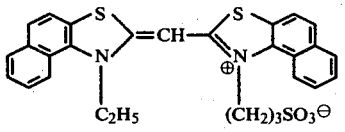

II - 3

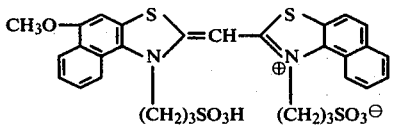

II - 4

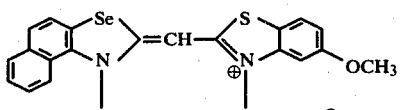

II - 5

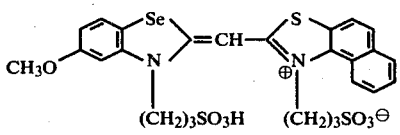

II - 6

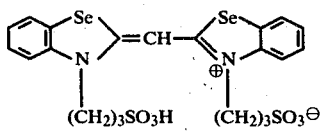

II - 7

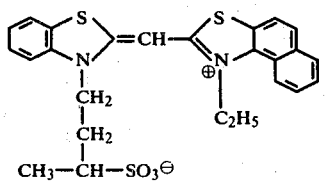

-continued
II - 8
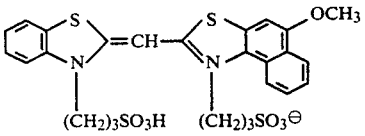
II - 9
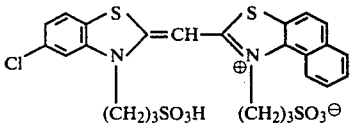
II - 10
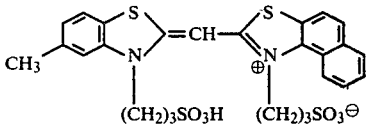
II - 11
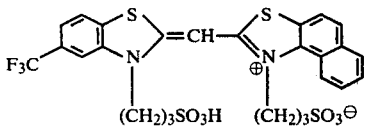
II - 12
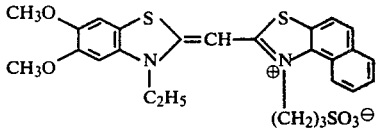
II - 13
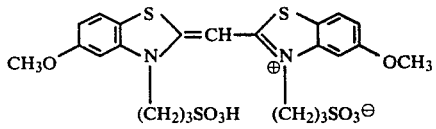
II - 14
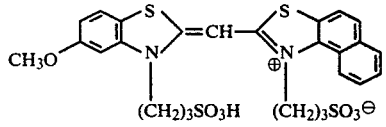
II - 15
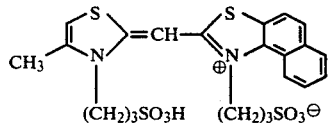
II - 16
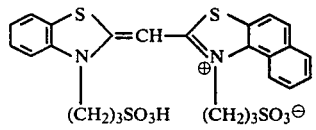
II - 17
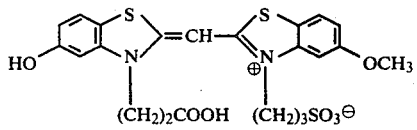
II - 18
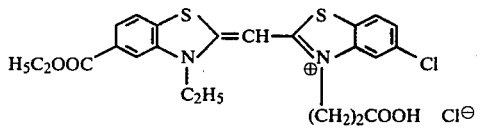
Compounds of the general formula III
III - 1
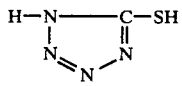
III - 2
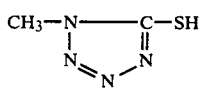
III - 3
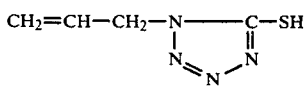
-continued
III - 4
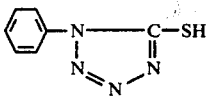
III - 5
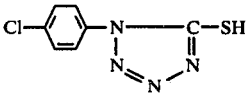
III - 6
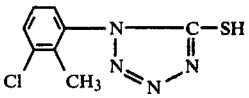
III - 7
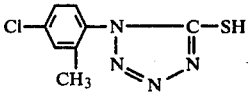
III - 8
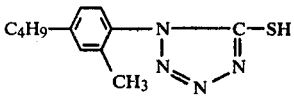
III - 9
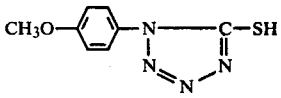
III - 10
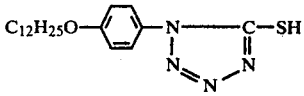
III - 11
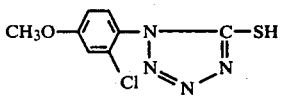
III - 12
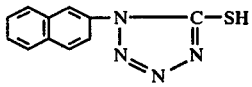
III - 13
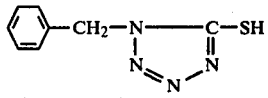
III - 14
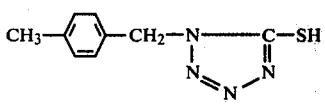
III - 15
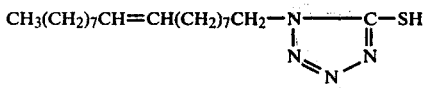
III - 16
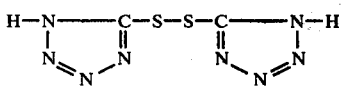
III - 17
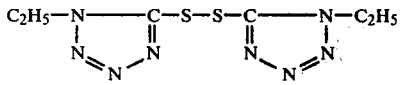
III - 18
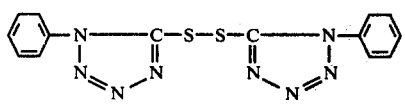
III - 19
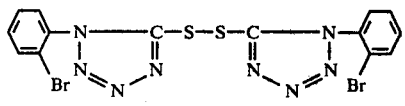
III - 20
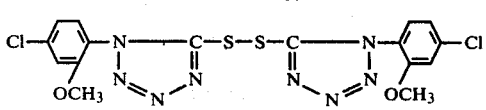

-continued

III - 21

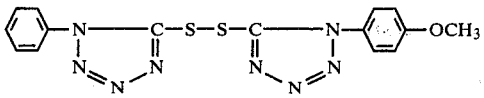

III - 22

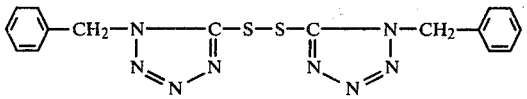

III - 23

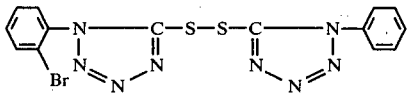

III - 24

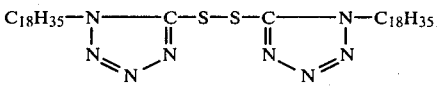

The present invention can be applied to any light-sensitive silver halide photographic material such as a black-and-white light-sensitive material for the general use (e.g. negative, reversal and photographic print paper, light-sensitive material for use in the printing, light-sensitive material having high resolving power, light-sensitive material for use in the microphotography, light-sensitive material for use in X-ray photography) and light-sensitive material for use in color photography (e.g. negative, reversal and photographic printing paper). As a silver halide in the silver halide photographic emulsion used in these light-sensitive materials, any one such as silver chloride, silver bromide, silver chlorobromide, silver choroiodobromide and silver iodobromide may be used and, in particular, application of the present invention to the silver iodobromide is the most effective. As a binder for use in the silver halide photographic emulsion, a natural or synthetic high molecular weight substance such as gelatine, casein or polyvinylalcohol can be used alone or in conjunction.

Inclusion of a combination of the compounds of the general formulae I and II or a combination of the compounds of the general formulae I, II and III into a constructive layer of the light-sensitive silver halide photographic material is most effectively made by the addition thereof into the silver halide photographic emulsion layer, but the addition to a non-light-sensitive layer adjacent to the photographic emulsion layer, for example, adjuvant layers such as sublayer, inter layer and protective layer is also effective. For the light-sensitive material for use in color photograph, the photographic emulsion layer to which the above combination is to be added may be any layer of the red-sensitive layer, green sensitive layer or blue-sensitive layer. Each of the compounds of the general formulae I, II and III as utilized in the present invention is added as a solution in a water-miscible organic solvent such as methyl alcohol, ethyl alcohol or acetone. Further, the addition is made at any stage during the preparation steps. In case that the above combination is added to the silver halide photographic emulsion, however, it is preferably added during the second ripening or immediately before the coating step. The amount of each compound to be added various depending upon the construction formula of the compound used or the type of the constructive layer to which such compound is added. When the aforementioned combination is added to the non-light-sensitive layer, the range of 0.1–50 mg/m$^2$ is preferable for the compounds of the general formulae I and II, respectively, and the range of 0.01–10 mg/m$^2$ is preferable for the compound of the general formula III. Further, when the above combination is added to the silver halide photograhic emulsion, the range of 1–1000 mg/mol Ag is preferable for the compound of the general formula I and II, respectively, and the range of 1–200 mg/mol Ag for the compound of the general formula III. As the mixing ratio at which the combination of the compound of the general formula I and the compound of the general formula II exhibits the optimum effect, the ratio from 1:5 L to 5:1 is preferable. Furthermore when the compounds of the general formulae I, II and III, respectively, are used in conjunction, it is preferable to use the compound of the general formula III at a ratio from 10:1 to 1:5 against the total amount of the compounds of the general formulae I and II.

The light-sensitive silver halide photographic material may optionally include known photographic additives, for example, hardening agent, stabilizer, pH adjusting agent, viscosity-increasing agent, coating aid, UV-absorber or surface-properties improving agent.

Further, in the case of the light-sensitive material for use in color photograph, it is necessary to use, in addition to the above sensitizing dyes of the general formulae I and II, a red-sensitive or green-sensitive sensitizing dye in ortho to sensitize the corresponding light-sensitive silver halide photographic emulsion layer. As a coupler used for the light-sensitive material for use in color photograph, there can be included, for example, an open-chain methylene series yellow coupler, 5-pyrazolone series magenta coupler, phenol or naphthol series cyan coupler and the like. These couplers may be so-called 2-equivalent type or 4-equivalent type coupler. Furthermore, it is possible to use, in conjunction with these couplers, an azo type colored coupler to achieve automasking, osazone type compound or diffusible dye releasing type coupler. In addition, with a view to improving photographic characteristics, such couplers as so-called competing coupler, DIR Coupler (Development Inhibitor Releasing Coupler) or BAR coupler (Bleach Accelerator Releasing Coupler) can be included in conjunction with the above couplers. Moreover, it is possible to add an anti-color stain agent, optical whitening agent or the like.

As a support of the light-sensitive silver halide photographic material of the present invention, any substance such as not only baryta paper and polyolefin-coated paper but also cellulose triacetate and plastic film of polyethylene terephthalate, polycarbonate, and the like can be used.

The following examples will concretely explain the present invention, but the embodiments of the practice of this invention should not be limited thereby.

EXAMPLE 1

At a second ripening stage, a high speed silver iodobromide photographic emulsion for X-ray photography containing 2 mol% of silver iodide was subjected to gold sensitization. Thereafter, an appropriate amount of each of 4-hydroxy-6-methyl-1,3,3a,7-tetrazaindene as a stabilizer, formalin as a hardening agent and saponin as a coating aid was added to said photographic emulsion. The photographic emulsion thus prepared was divided into several portions and to each of such portions were added the exemplified compounds I-1, I-2 and I-5 as represented by general formula I and exemplified compounds II-1, II-9 and II-13 as represented by general formula II, alone (for comparison) or in conjunctions (according to the present invention) as a solution in methanol. Each of the resulting photographic emulsion was then applied on polyethylene terephthalate film. After drying, a 3% aqueous gelatin solution to which formalin as a hardening agent and saponin as a coating aid had been added was applied on each of the films so that the amount of gelatin might be 1.5 g/m$^2$ and then dried to give a sample. To each of the samples thus obtained, 3.2 cms of exposure was given by using KS-1 type sensitometer (manufactured by Konishiroku Photo Industry Co., Ltd.). Then, the samples were developed at 40° C. for 30 seconds with the developing solution having the following composition and subsequently fixed, washed with water and dried according to an ordinary procedure.

| Formulation of developing liquid: | |
|---|---|
| Sodium sulfite | 70 g |
| Hydroquinone | 10 g |
| Boric anhydride | 1 g |
| Sodium carbonate 1 hydrate | 20 g |
| 1-phenyl-3-pyrazolidone | 0.35 g |
| Sodium hydroxide | 3 g |
| 5-Methylbenzotriazole | 0.05 g |
| Potassium bromide | 5 g |
| Glutaraldehyde hydrogensulfite | 15 g |
| Acetic acid | 5 g |
| Water to make up | 1 litre |

With regard to each sample thus developed, the density was measured to estimate values of light-sensitivity and fog. Results obtained are shown in Table 1.

TABLE 1

| | Sample No. | Compound I Amount added | Compound II Amount added | Fog | Light-Sensitivity |
|---|---|---|---|---|---|
| Comparison | 1 | none | none | 0.19 | 100 |
| | 2 | I-1 300 | none | 0.15 | 106 |
| | 3 | I-2 300 | none | 0.17 | 101 |
| | 4 | I-5 300 | none | 0.14 | 98 |
| | 5 | none | II-1 300 | 0.15 | 114 |
| | 6 | none | II-9 300 | 0.15 | 96 |
| | 7 | none | II-13 300 | 0.13 | 110 |
| Present invention | 8 | I-1 100 | II-9 100 | 0.11 | 102 |
| | 9 | I-1 200 | II-9 100 | 0.10 | 104 |
| | 10 | I-1 200 | II-1 100 | 0.10 | 118 |
| | 11 | I-1 200 | II-13 100 | 0.09 | 109 |
| | 12 | I-2 200 | II-9 50 | 0.11 | 102 |
| | 13 | I-2 200 | II-9 100 | 0.10 | 101 |
| | 14 | I-2 200 | II-13 100 | 0.09 | 105 |
| | 15 | I-5 200 | II-9 100 | 0.10 | 100 |
| | 16 | I-5 200 | II-13 100 | 0.09 | 108 |

Note:
Amounts of compound added is given in terms of mg/l mol Ag and values of light-sensitivity are relative values to the light-sensitivity of a sample free from any additive, as defined 100.

From the results of the above table, it is noted that use of both compounds in conjunction rather increases light-sensitivity and outstandingly inhibits fog.

EXAMPLE 2

On a cellulose triacetate film base, each of the constructive layers 1 to 12 as defined below was applied successively to form a reversal type light-sensitive material for use in color photography. Among these layers, the compositions of layers 10 and 11 which are blue-sensitive silver halide photographic emulsion layers were varied as shown in Table 2 to give 7 types of samples. Further, to each of the following constructive layers, were added appropriate amounts of 1,3,5-triacryloylhexahydro-s-triazine and hexamethylene-bis(N,N-ethyleneurea) as the hardening agent and saponin as a coating aid and dextran sulfate as a viscosity-adjusting agent.

Layer 1: Anti-halation layer

A gelatin solution containing black colloidal silver and latex of a copolymerization polymer of ethyl acrylate and methacrylic acid serving as a film improving agent was applied at a rate of 2.9 mg of silver halide calculated in silver and 27 mg of gelatin per 100 cm$^2$.

Layer 2: Inter layer

A gelatin solution was applied at a rate of 11 mg/100 cm$^2$ of gelatin.

Layer 3: Low speed, red-sensitive photographic emulsion layer

A silver iodobromide emulsion containing 6 mol% of silver iodide and having 0.2–0.4$\mu$ of particle diameter was subjected to the optical sensitization with red-sensitive sensitizing dyes comprising 285 mg/l mol silver halide of anhydro-3,3'-di-(3-sulfopropyl)-5,5'-dichloro-9-ethyl-thiacarbocyanine hydroxide (Dye p-1), 38.5 mg/l mol silver halide of anhydro-3,3'-di-(3-sulfopropyl)-4,5,4',5'-dibenzothiacarbocyanine hydroxide (Dye p-2) and 116 mg/l mol AgX of anhydro-1,3'-diethyl-3-(3-sulfopropyl)-5-trifluoromethyl-4',5'-benzobenzimidazolethiacarbocyanine hydroxide (Dye p-3). To the resulting photographic emulsion, a dispersion solution in which 2-($\alpha,\alpha,\beta,\beta,\gamma,\gamma,\delta,\delta$-octafluorohexanamido)-5-[2-(2,4-di-tert-amylphenoxy)hexanamido] phenol as the cyan coupler dissolved in tricresyl phosphate, had been protect dispersed according to an ordinary manner, was added at the rate of 0.20 mol of the coupler per 1 mol of silver halide. Further, 4-hydroxy-6-methyl-1,3,3a,7-tetrazaindene as the stabilizing agent, the exemplified compound III-4 as the fog inhibitor and poly-N-vinylpyrrolidone as the physical development inhibiting agent were added and the photographic emulsion thus obtained was applied at the rate of 6.5 mg silver halide calculated in silver and 18 mg of gelatin per 100 cm$^2$.

Layer 4: High speed, red-sensitive photographic emulsion layer

A high speed silver iodobromide emulsion containing 6 mol% of silver iodide and having 0.6–1.1$\mu$ of particle diameter was subjected to the optical sensitization with the afore-mentioned red-sensitive sensitizing dyes, 121 mg of Dye p-1, 12.1 mg of Dye p-2 and 36.3 mg of Dye p-3 per 1 mol silver halide. Then, the same coupler dispersion solution, stabilizing agent, fog inhibitor and physical development inhibiting agent as used for layer 3 were added. The photographic emulsion thus obtained was applied at the rate of 6.5 mg of silver halide calculated in silver and 16 mg of gelatin per 100 cm$^2$.

Layer 5: Inter layer

A gelatin solution containing a dispersion solution in which the mixture of 2-sec-hexadecyl-5-methylhydroquinone and 2-sec-octadecyl-5-methylhydroquinone as an anti-color stain agent dissolved in dioctylphthalate had been protect-dispersed according to an ordinary manner was applied at the rate of 9 mg of gelatin/100 cm$^2$.

Layer 6: Low speed, green-sensitive photographic emulsion layer

A silver iodobromide emulsion containing 6 mol% of silver iodide and having 0.2–0.4μ of particle diameter was subjected to an optical sensitization with green-sensitive sensitizing dyes comprising 103 mg/l mol silver halide of anhydro-3,3'-di-(3-sulfopropyl)-5,5'-diphenyl-9-ethyloxacarbocyanine hydroxide (Dye o-1), 198 mg/l mol AgX of anhydro-3,3'-di-(3-sulfopropyl)-5,6,5',6'-dibenzoxacarbocyanine hydroxide (Dye o-2) and 253 mg/l mol AgX of anhydro-3,3'-di-(3-sulfopropyl)-5,5'-dichloro-9-ethyl-oxacarbocycanine hydroxide (Dye o-3). To the resulting photographic emulsion, a dispersion solution in which 1-(2,4,6-trichlorophenyl)-3-(3-dodecylsuccinimidobenzamido)-5-pyrazolone and 1-(2,4,6-trichlorophenyl)-3-[3-(2,4-di-tert-amylphenoxyacetamido)benzamido]-5-pyrazolone as a magenta couplers dissolved in tricresyl phosphate had been protect-dispersed according to an ordinary manner was added at the rate per 1 mol of silver halide of 0.031 mol of the former and 0.123 mol of the latter. Further, 4-hydroxy-6-methyl-1,3,3a,7-tetrazaindene as a stabilizing agent, the exemplified compound III-4 as a fog inhibitor and poly-N-vinylpyrrolidone as a physical development inhibiting agent were added and the photographic emulsion thus obtained was applied at the rate of 6.7 mg of silver halide calculated in silver and 15 mg of gelatin per 100 $cm^2$.

Layer 7: High speed, green-sensitive photographic emulsion layer

A high speed silver iodobromide photographic emulsion containing 6 mol% of silver iodide and having 0.6–1.1μ of particle diameter was subjected to optical sensitization with the afore-mentioned green-sensitive sensitizing dyes, 37.4 mg of Dye o-1, 70.8 mg of Dye o-2 and 91.0 mg of Dye o-3 per 1 mol silver halide. Then, the same coupler dispersion solution, stabilizing agent, fog inhibitor and physical development inhibiting agent as used for the layer 6 were added. The photographic emulsion thus obtained was applied at the rate of 6.7 mg of silver halide calculated in silver and 13 mg of gelatin per 100 $cm^2$.

Layer 8: Inter layer

A gelatin solution was applied at the rate of 9 mg of gelatin/100 $cm^2$.

Layer 9: Yellow filter layer

A gelatin solution containing a dispersion solution in which anti-color stain agents, i.e. 2-sec-hexadecyl-5-methylhydroquinone and 2-sec-octadecyl-5-methylhydroquinone had been protect dispersed and yellow colloidal silver was applied at the rate of 1.0 mg of silver halide calculated in silver and 9 mg of gelatin per 100 $cm^2$.

The sample to which the above layers 1 through 9 had been applied was divided into 7 portions and, to each of the 7 portions, layer 10 and layer 11 to each of which the exemplified compounds of this invention were added as defined in Table 2, were applied, respectively. Finally, the common layer 12 was applied to give samples No. 1–7.

TABLE 2

| Additives to Layers 10 and 11 and Amounts Thereof | | |
|---|---|---|
| Sample No. | Exemplified Compound I mg/l mol AgX | Exemplified Compound II mg/l mol AgX |
| 1 | none | none |
| 2 | I-1 200 | none |
| 3 | I-5 200 | none |
| 4 | none | II-1 200 |
| 5 | none | II-14 200 |
| 6 | I-1 100 | II-1 100 |
| 7 | I-5 100 | II-100 |

Layer 10: Low-speed, blue-sensitive photographic emulsion layer

A low speed, silver iodobromide photographic emulsion containing 6 mol% of silver iodide and having 0.3–0.6μ of particle diameter was divided into 7 portions. After the addition of such additives as shown in Table 2 to each portion, a dispersion liquid in which, as a yellow coupler, α-[4-(1-benzyl-2-phenyl-3,4-dioxo-1,2,4-triazolizinyl]-α-pivalyl-2-chloro-5-[α-(dodecyloxycarbonyl)ethoxycarbonyl]acetanilide had been protect-dispersed was further added to each portion at a rate of 0.2 mol of coupler/1 mole AgX. Subsequently, 4-hydroxy-6-methyl-1,3,3a,7-tetrazaindene as a stabilizing agent and poly-N-vinylpyrrolidone as a physical development inhibiting agent were added, respectively, and then the resulting photographic emulsion was applied on the layer 9 at the rate of 7.1 mg of silver halide calculated in silver and 16 mg of gelatin per 100 $cm^2$.

Layer 11: High speed, blue-sensitive photographic emulsion layer

A high speed, silver iodobromide photographic emulsion containing 6 mol% of silver iodide and having 0.6–1.1μ of particle diameter was divided into 7 portions and to each portion, similarly as in layer 10 were added the additives as shown in Table 2, dispersion solution of the yellow coupler, stabilizing agent and physical development inhibiting agent. The photographic emulsion thus obtained was applied at the rate of 7.1 mg of silver halide calculated in silver and 14 mg of gelatine per 100 $cm^2$.

Layer 12: Protective layer

A gelatin solution which contains a short wavelength light cut dye, i.e. 2-(3-p-toluenesulfonyl-3-dodecyloxycarbonylarylidene)-1-(3-sulfopropyl)pyrrolidine potassium salt, UV absorber, i.e. a mixture of 2-benztriazolyl-4-tert-butylphenol, 2-benztriazolyl-4,6-di-tert-butylphenol, 2-(5-chlorobenztriazolyl)-4,6-di-tert-butylphenol and 2-(5-chlorobenztriazolyl)-4-methyl-6-tert-butyl-phenol, lubricant, i.e. glycerin trilaurate, matting agent, i.e. colloidal silica, coating aid such as a succinic acid higher alkyl ester sodium sulfonate, succinic acid higher fluoro alkyl ester sodium sulfonate and alkyl phenol polyalkyleneoxide sodium sulfonate was applied to each of the 7 samples at the rate of 9 mg of gelatin/100 $cm^2$.

To these 7 samples, white stepwise exposure with KS-7 type sensitometer (manufactured by Konishiroku Photo Industry Co., Ltd.) was given partly immediately after the preparation of the samples (for the same day test), after leaving said samples to stand for 3 days at 50° C. and 80% RH (for the high humidity test) and after leaving said samples to stand for 3 days at 55° C. and 27% RH (for the high temperature test). Thereafter, the reversal development was carried out according to the following order of succession of steps:

| Processing Step | Temperature (° C.) | Processing Time (min.) |
|---|---|---|
| First development | 38 | 6 |
| First washing with water | 38 | 2 |
| Reversal | 38 | 2 |
| Color development | 38 | 6 |
| Adjustment | 38 | 2 |
| Bleaching | 38 | 6 |
| Fixing | 38 | 4 |
| Final washing with water | 38 | 4 |
| Stabilization | 38 | 0.5 |
| Drying | 50 | |

The composition of the processing solution used in each of the above steps is as follows:

| | |
|---|---|
| First development: | |
| Aqueous nitrilo-N,N,N-trimethylenephosphonic acid 5 sodium solution (45%) | 1.0 ml |
| Potassium sulfite 2 hydrate | 35.0 g |
| Sodium bromide | 2.2 g |
| Sodium thiocyanate | 1.0 g |
| Potassium iodide | 4.5 mg |
| Potassium hydroxide | 4.5 g |
| Diethylene glycol | 12.0 ml |
| 1-phenyl-4-hydroxymethyl-3-pyrazolidone | 1.5 g |
| Anhydrous potassium carbonate | 14.0 g |
| Sodium hydrogen carbonate | 12.0 g |
| Hydroquinone potassium sulfonate | 22.0 g |
| Water to make up | 1 liter |
| pH adjusted to 9.6 | |
| Reversal: | |
| Propionic acid | 12.0 ml |
| Anhydrous stannous chloride | 1.5 g |
| p-Aminophenol | 0.5 mg |
| Sodium hydroxide | 5.0 g |
| Aqueous nitrilo-N,N,N-trimethylenephosphonic acid 5 sodium solution (45%) | 15.0 ml |
| Water to make up | 1 liter |
| pH Being adjusted to 5.8. | |
| Color development: | |
| Aqueous nitrilo-N,N,N-trimethylenephosphonic acid 5 sodium solution (45%) | 5.0 ml |
| Phosphoric acid (85%) | 7.0 ml |
| Sodium bromide | 0.7 g |
| Potassium iodide | 30.0 mg |
| Potassium hydroxide | 20.0 g |
| Anhydrous sodium sulfite | 4.5 g |
| citrazinic acid | 1.3 g |
| 4-Amino-N-ethyl-N-(β-methanesulfonamid-ethyl) -m-toluidinesesquisulfate . 1 hydrate | 11.0 g |
| 1,8-Hydroxy-3,6-dithiaoctane | 1.0 g |
| Water to make up | 1 liter |
| pH Being adjusted to 11.7. | |
| Adjusting: | |
| Potassium sulfite 2 hydrate | 15.0 g |
| Ethylenediaminetetraacetic acid | 8.0 g |
| α-Monothioglycerol | 0.5 ml |
| Water to make up | 1 liter |
| pH Being adjusted to 6.2. | |
| Bleaching: | |
| Potassium nitrate | 25.0 g |
| Potassium bromide | 80.0 g |
| Ethylenediaminetetraacetic acid iron (III) ammonium | 110.0 g |
| Hydrobromic acid (48%) | 30.0 ml |
| Ethylenediaminetetraacetic acid | 4.0 g |
| Water to make up | 1 liter |
| pH Being adjusted to 5.7. | |
| Fixing: | |
| Ammonium thiosulfate | 55.0 g |
| Ethylenediaminetetraacetic acid 2 sodium | 0.8 g |
| Sodium metabisulfite | 7.5 g |
| Sodium hydroxide | 1.5 g |

-continued

| | |
|---|---|
| Water to make up | 1 liter |
| pH Being adjusted to 6.6 | |
| Stabilizing: | |
| Formalin (35%) | 6.0 ml |
| Konidax (manufactured by Konishiroku Photo Industry Co., Ltd.) | 7.5 ml |
| Water to make up | 1 liter |

With regard to each sample thus processed, the density was measured with blue light to obtain the relative speed against the speed shown by the sample No. 1 on the same day, which is defined as 100. Further, the maximum density Dmax was also determined. Results obtained are shown in Table 3.

TABLE 3

| | The same day | | High humidity test | | High temperature test | |
|---|---|---|---|---|---|---|
| Sample No. | Speed | Dmax | Speed | Dmax | Speed | Dmax |
| 1 | 100 | 2.84 | 94 | 2.61 | 105 | 2.65 |
| 2 | 98 | 3.02 | 94 | 2.82 | 101 | 2.87 |
| 3 | 96 | 3.08 | 95 | 2.80 | 105 | 2.90 |
| 4 | 94 | 3.14 | 93 | 2.90 | 98 | 2.95 |
| 5 | 96 | 3.08 | 95 | 2.85 | 104 | 2.87 |
| 6 | 101 | 3.50 | 100 | 3.47 | 102 | 3.48 |
| 7 | 98 | 3.45 | 97 | 3.43 | 100 | 3.44 |

From the results of the above table, Samples 6 and 7 to which the light-sensitive photographic materials of this invention were added show the maximum density higher than any of the other comparative samples on the same day. This means that formation of fog was less in the first development. Furthermore, in contrast to the fact that all of the comparative samples show the decrease in the maximum density caused by a formation of fog in the high humidity test and in the high temperature test, the samples to which the present invention was applied show quite no decrease in the density in such tests and satisfactorily inhibit formation of fog even during said tests, achieving thereby stabilized efficiency.

EXAMPLE 3

In a quite similar manner as in Example 2 except for that the additives to layer 10 and layer 11 were changed as defined in Table 4, the following 7 samples were prepared:

TABLE 4

| Sample No. | Exemplified compound I mg/l mol AgX | Exemplified Compound II mg/l mol AgX | Exemplified Compound III mg/l mol AgX |
|---|---|---|---|
| 1 | none | none | III-4 50 |
| 2 | I-1 200 | none | III-4 50 |
| 3 | none | II-1 200 | III-4 50 |
| 4 | I-1 100 | II-1 200 | III-4 50 |
| 5 | I-1 100 | II-1 100 | none |
| 6 | I-1 100 | II-14 100 | III-4 50 |
| 7 | I-1 100 | II-14 100 | none |

AgX represents "silver halide".

Each of the above samples was subjected, before an exposure, to the test on the same day, the high humidity test and the high temperature test similarly as Example 2, and then to white stepwise exposure. Thereafter, the reversal development was carried out according to the following order of succession of steps:

| Processing Step | Temperature (°C.) | Processing Time (min.) |
|---|---|---|
| First development | 38 | 6 |
| First washing with water | 38 | 2 |
| Reversal | 38 | 2 |
| Color development | 38 | 6 |
| Adjustment | 38 | 2 |
| Bleaching | 38 | 6 |
| Fixing | 38 | 4 |
| Final washing with water | 38 | 4 |
| Stabilization | 38 | 0.5 |
| drying | 50 | |

The composition of the processing solution used in each of the above steps is as follows:

| | |
|---|---|
| First development: | |
| Part A: | |
| Sodium polyphosphate | 2.0 g |
| Anhydrous sodium sulfite | 25.0 g |
| Anhydrous potassium carbonate | 18.0 g |
| Potassium hydrogen carbonate | 5.0 g |
| Anhydrous sodium carbonate | 6.0 g |
| Sodium bromide | 2.5 g |
| Sodium thiocyanate | 1.0 g |
| Diethylene glyol | 10.0 ml |
| Hydroquinone sodium monosulfonate | 25.0 g |
| 1-Phenyl-3-pyrazolidone | 1.2 g |
| Water to make up | 1 litre |
| pH adjusted to 9.7. | |
| Part B: | |
| Sodium bromide | 1.0 g |
| Potassium iodide | 5.0 mg |
| Glacial acetic acid | 1.0 ml |
| Anhydrous sodium sulfite | 10.0 mg |
| Water to make up | 5.0 ml |
| pH adjusted to 1.8. | |
| Part A and part B were used by mixing together. (pH9.6) | |
| Reversal: | |
| Anhydrous stannous chloride | 1.5 g |
| Anhydrous sodium acetate | 10.0 g |
| Sodium tetrapolyphosphate ($Na_6P_4O_{13}$) | 10.0 g |
| Hydroxylamine sulfate | 0.1 g |
| Glacial acetic acid | 1.5 ml |
| Water to make up | 1 liter |
| pH adjusted to 5.8. | |
| Color development: | |
| Part A: | |
| 1,8-Hydroxy-3,6-dithiaoctane | 1.0 g |
| Sodium polyphosphate | 5.0 g |
| Anhydrous sodium sulfite | 5.0 g |
| 3 Potassium phosphate 3 hydrate | 25.0 g |
| Potassium hydroxide | 6.5 g |
| Citrazinic acid | 1.3 g |
| 4-Amino-N-ethyl-N-(β-methanesulfonamid-ethyl)-m-toluidinesesquisulfate 1 hydrate | 12.0 g |
| Water to make up | 1 liter |
| pH adjusted to 12.0. | |
| Part B: | |
| Sodium bromide | 0.7 g |
| Potassium iodide | 40.0 mg |
| Glacial acetic acid | 1.0 ml |
| Anhydrous sodium sulfite | 50.0 mg |
| Water to make up | 5.0 ml |
| pH adjusted to 1.7. | |
| Part A and part B were used by mixing together (pH 11.8). | |
| Adjusting: | |
| Anhydrous potassium sulfite | 10.0 g |
| β-Mercaptopropionic acid | 0.5 ml |
| Ethylenediaminetetraacetic acid | 10.0 g |
| Water to make up | 1 liter |
| pH adjusted to 6.2. | |
| Bleaching: | |
| Ammonium bromide | 80.0 g |
| Ethylenediaminetetraacetic acid iron (III) ammonium | 150.0 g |
| Ethylenediaminetetraacetic acid 2 sodium | 5.0 g |

-continued

| | |
|---|---|
| Aqueous ammonia | 2.5 ml |
| Water to make up | 1 liter |
| pH adjusted to 5.6. | |
| Fixing: | |
| Sodium bisulfite | 9.0 g |
| Ammonium thiosulfate | 75.0 g |
| Ethylenediaminetetraacetic acid 2 sodium | 1.0 g |
| Sodium hydroxide | 3.0 g |
| Water to make up | 1 liter |
| pH adjusted to 6.6. | |
| Stabilizing: | |
| Formalin (35%) | 6.0 ml |
| Konidax (manufactured by Konishiroku Photo. Industry Co., Ltd.) | 7.5 ml |
| Water to make up | 1 liter |

With regard to each sample thus processed, the density was measured with blue light to obtain the relative speed against the speed shown by the sample No. 1 on the same day, which is defined as 100. Further, the maximum density Dmax was also determined. Results obtained are shown in Table 5.

Table 5

| Sample | The same day | | High humidity test | | High temperature test | |
|---|---|---|---|---|---|---|
| No. | Speed | $D_{max}$ | Speed | $D_{max}$ | Speed | $D_{max}$ |
| 1 | 100 | 3.10 | 96 | .90 | 101 | 2.94 |
| 2 | 98 | 3.17 | 95 | 2.91 | 99 | 2.96 |
| 3 | 99 | 3.15 | 93 | 2.93 | 97 | 2.97 |
| 4 | 113 | 3.61 | 110 | 3.59 | 113 | 3.60 |
| 5 | 106 | 3.45 | 105 | 3.40 | 105 | 3.42 |
| 6 | 107 | 3.58 | 106 | 3.58 | 106 | 3.58 |
| 7 | 101 | 3.43 | 101 | 3.38 | 102 | 3.40 |

As noted from the results of the above table, all of samples 4 to 7 shows high speed and high maximum density due to less fog during the first development. Further, also in the high humidity test and the high temperature test, such samples satisfactorily inhibit formation of fog without causing any decrease in the speed. It is thus apparent that decrease in the maximum density can be avoided and stabilized efficiency is achievable thereby.

EXAMPLE 4

On a cellulose triacetate film base, each of the constructive layers 1 to 9 as defined below was applied successively to form a negative type light-sensitive material for use in color photography. Among these layers, the compositions of layer 8 which is the blue-sensitive silver halide photographic emulsion layer was varied as shown in Table 6 to give 5 types of samples. Further, to each of the following constructive layers, were added appropriate amounts of 1,3,5-triacryloylhexahydro-s-triazine and 1,2-bis(vinylsulfonyl)ethane as a hardening agent, saponin as a coating aid and dextran sulfate as a viscosity-adjusting agent.

Layer 1: Anti-halation layer

A gelatin solution containing black colloidal silver was applied at a rate of 3 mg of silver and 30 mg of gelatin per 100 $cm^2$.

Layer 2: Red-sensitive photographic emulsion layer

A mixture of an equivalent amount of a high speed, silver iodobromide photographic emulsion containing 8 mol% of silver iodide and having 0.7–1.5μ of particle diameter and a low speed, silver iodobromide photographic emulsion containing 8 mol% of silver iodide and having 0.2–0.5μ of particle diameter was subjected to an optical sensitization with a red-sensitive sensitizing dye. To the resulting photographic emulsion, a dispersion solution in which 5 parts by weight of colored cyan coupler, 1-hydroxy-4-(2-ethoxycarbonylphenylazo)-N-[α-2,4-di-tert-amylphenoxy)butyl]-2-naphthamide and 20 parts by weight of cyan coupler, 1-hydroxy-N-[δ-(2,4-di-tert-amylphenoxy)-butyl]-2-naphthamide had been dissolved in tricresyl phosphate and protect-dispersed according to an ordinary manner was added so that the amount of the cyan coupler might be 0.094 mol per mol of silver halide. Then, the emulsion was coated at a rate of 34 mg of silver halide calculated in silver and 45 mg of gelatin per 100 $cm^2$.

Layer 3: Inter layer

A gelatin solution was applied at a rate of 13 mg of gelatine/100 $cm^2$.

Layer 4: Low speed, green-sensitive photographic emulsion layer

A silver iodobromide photographic emulsion containing 8 mol% of silver iodide and having 0.5–0.8μ of particle diameter was subjected to an optical sensitization with a green-sensitive sensitizing dye. To the photographic emulsion thus treated, a dispersion in which 5 parts by weight of colored magenta coupler, 1-(2,4,6-trichlorophenyl)-3-{3-[α-(2,4-di-tert-amylphenoxy)acetamido]anilino}-4-(methoxyphenylazo)-5-pyrazolone and 26 parts by weight of magenta coupler, 1-(2,4,6-trichlorophenyl)-3-[3-(2,4-di-tert-amylphenoxyacetamido)benzamido]-5-pyrazolone had been dissolved in tricresylphosphate together with 2 parts by weight of the development inhibitor releasing compound, 2-(1-phenyl-5-tetrazolylthio)-6-[α-(2,4-di-tert-amylphenoxy)acetamido]-indanone(1) and protect dispersed according to an ordinary manner was added so that the amounts of the coupler and the development inhibitor releasing compound might be 0.10 mol and $7.5\times10^{-3}$ mol, respectively, per mol of silver halide. The resulting photographic emulsion was then applied at a rate of 14 mg of silver halide calculated in silver and 29 mg of gelatin per 100 $cm^2$.

Layer 5: High speed, green-sensitive photographic emulsion layer

A silver iodobromide photographic emulsion containing 8 mol% of silver iodide and having 0.7–1.5μ of particle diameter was subjected to an optical sensitization with a green-sensitive sensitizing dye. To the resulting photographic emulsion, the dispersion solution used in the above layer 4 was added at a rate of 0.035 mol of the coupler and $2.6\times10^{-4}$ mol of the development inhibitor releasing compound per mol of silver halide, respectively. The resulting emulsion was then applied at a rate of 17 mg of silver halide calculated in silver and 25 mg of gelatin per 100 $cm^2$.

Layer 6: Inter layer

A gelatin solution was applied at a rate of 13 mg of gelatin/100 $cm^2$.

Layer 7: Yellow filter layer

A gelatin solution containing yellow colloidal silver was applied at a rate of 1 mg of silver/100 $cm^2$ and 13 mg of gelatin/100 $cm^2$.

The sample to which the above layers 1 through 7 had been applied was divided into 5 portions and, to each of the 5 portions, the layer 8 to which the exemplified compound of this invention was added as defined in Table 6 was applied. Finally, the common layer 9 was applied to give five types of samples.

Table 6

| Sample No. | Exemplified compound I mg/l mol AgX | Exemplified compound II mg/l moll AgX | Exemplified compound III mg/l mol AgX |
|---|---|---|---|
| 1 | none | none | III-4 50 |
| 2 | I-1 200 | none | III-4 50 |
| 3 | none | II-13 200 | III-4 50 |
| 4 | I-1 100 | II-13 100 | none |
| 5 | I-1 100 | II-13 100 | III-4 50 |

Layer 8: Blue-sensitive photographic emulsion layer

A silver iodobromide photographic emulsion containing 7 mol% of silver iodide and having 0.5–1.5μ of particle diameter was subjected to a chemical sensitization. To the resulting photographic emulsion, a dispersion solution in which a yellow coupler, α-[4-(1-benzyl-2-phenyl-3,3-dioxo-1,2,4-triazolizinyl)]-α-pivalyl-2-chloro-5-[γ-(2,4-di-tert-amylphenoxy)butylamido]-acetanilide had been protect dispersed was added at a rate of 0.21 mol of the coupler per mol of silver halide. The photographic emulsion thus obtained was divided into 5 portions and to each of such portions, the additives as defined in Table 6 were added, respectively, and the resulting emulsions were applied on the sample to which the layers up to layer 7 had been applied, at a rate of 10 mg of silver halide calculated in silver and 40 mg of gelatin per 100 $cm^2$, respectively.

Layer 9: Protective layer

A gelatin solution was applied at the rate of 13 mg of gelatin/100 $cm^2$.

Five samples thus obtained were subsequently subjected to the white stepwise exposure partly immediately (for the same day test), or after leaving said samples to stand for 3 days at 50° C. and 80% RH (for the high humidity test) or at 55° C. and 27% RH (for the high temperature test) and thereafter the following negative development process was carried out.

| Processing Step (38° C.) | Processing Time |
|---|---|
| Color development | 3 min. 15 sec. |
| Bleaching | 6 min. 30 sec. |
| Washing with water | 3 min. 15 sec. |
| Fixing | 6 min. 30 sec. |
| Washing with water | 3 min. 15 sec. |
| Stabilization | 1 min. 30 sec. |

The composition of the processing solution used in each of the above steps is as follows:

| | |
|---|---|
| Color development: | |
| 4-Amino-3-methyl-N-ethyl-N-(β-hydroxyethyl)-aniline sulfate | 4.8 g |
| Anhydrous sodium sulfite | 0.14 g |
| Hydroxylamine ½ sulfate | 1.98 g |
| Sulfuric acid | 0.74 g |
| Anhydrous potassium carbonate | 28.85 g |
| Anhydrous potassium hydrogen carbonate | 3.46 g |
| Anhydrous potassium sulfite | 5.10 g |
| Potassium bromide | 1.16 g |
| Sodium chloride | 0.14 g |
| Nitrilotriacetic acid . 3 sodium . 1 hydrate | 1.20 g |

-continued

| | |
|---|---|
| Potassium hydroxide | 1.48 g |
| Water to make up | 1 liter |
| Bleaching: | |
| Ethylenediaminetetraacetic acid iron ammonium salt | 100.0 g |
| Ethylenediaminetetraacetic acid . 2 ammonium | 10.0 g |
| Ammonium bromide | 150.0 g |
| Glacial acetic acid | 10.0 ml |
| Water to make up | 1 liter |
| pH adjusted to 6.0. | |
| Composition of fixing solution: | |
| Ammonium thiosulfate | 175.0 g |
| Anhydrous sodium sulfite | 8.6 g |
| Sodium metasulfite | 2.3 g |
| Water to make up | 1 liter |
| pH adjusted to 6.0. | |
| Stabilizing: | |
| Formalin (37%) | 1.5 ml |
| Konidax (manufactured by Konishiroku Photo Industry Co., Ltd.) | 7.5 ml |
| Water to make up | 1 liter |

With regard to each sample thus processed, the density was measured with blue light and the Dmin. value corresponding to the speed and fog was also determined. Results obtained are shown in Table 7.

Table 7

| Sample | Same day | | High humidity test | | High temperature test | |
|---|---|---|---|---|---|---|
| No. | Speed | Dmin | Speed | Dmin | Speed | Dmin |
| 1 | 100 | 0.80 | 96 | 0.85 | 98 | 0.88 |
| 2 | 102 | 0.77 | 99 | 0.82 | 101 | 0.83 |
| 3 | 101 | 0.78 | 98 | 0.82 | 100 | 0.84 |
| 4 | 107 | 0.64 | 106 | 0.65 | 107 | 0.65 |
| 5 | 106 | 0.59 | 105 | 0.57 | 107 | 0.58 |

From the above table, the samples No. 4 and No. 5 to which this invention was applied show high speed and low Dmin. values in the same day test. Furthermore, in contrast to the fact that all of the comparative samples show the decrease in the speed and increase in the Dmin. value in the high humidity test and in the high temperature test, the samples to which the present invention was applied possess quite stabilized efficiency.

EXAMPLE 5

On a support of a polyethylene-coated paper, each of the constructive layers 1 through 6 as given below was applied successively to form a color photograhic paper. However, the composition of the layer 1 which is a blue-sensitive photographic emulsion was varied as defined below to give 5 types of samples.

Layer 1: Blue-sensitive photographic emulsion layer

A silver chlorobromide photographic emulsion containing 10 mol% of silver chloride and having 0.4–0.8μ of particle diameter was subjected to a chemical sensitization. To the resulting photographic emulsion, a dispersion solution in which a yellow coupler, α-benzoyl-α-{4-[1,2-di-(4-tert-butylbenzyl)-3,5-dioxo-1,2,4-triazolizinyl]}-5-[γ-(2,4-di-tert-amylphenoxy)-butylamido]acetanilide had been protect-dispersed according to an ordinary manner was added at a rate of 0.35 mol of the coupler per mol of silver halide. The photographic emulsion thus obtained was divided into 5 portions and to each of such portions, the additives as defined in Table 8 were added, respectively, and the resulting emulsions were applied on said support at a rate of 5 mg of silver halide calculated in silver and 37 mg of gelatin per 100 $cm^2$.

Table 8

| Sample No. | Additives to Layer 1 and Amount thereof: Exemplified compound I mg/l mol AgX | Exemplified compound II mg/l mol AgX | Exemplified compound III mg/l mol AgX |
|---|---|---|---|
| 1 | I-1 200 | none | III-4 50 |
| 2 | I-5 200 | none | III-4 50 |
| 3 | none | II-6 200 | III-4 50 |
| 4 | I-1 100 | II-6 100 | III-4 50 |
| 5 | I-5 100 | II-6 100 | III-4 50 |

Layer 2: Inter Layer

A gelatin solution was applied at a rate of 9 mg of gelatin/100 $cm^2$.

Layer 3: Green-sensitive photographic emulsion layer

A silver chlorobromide photographic emulsion containing 20 mol% of silver chloride and having 0.2–0.4μ of particle diameter was subjected to an optical sensitization by adding thereto as a sensitizing dye, anhydro-3,3'-(2-sulfoethyl)-5-phenyl-9-ethyloxacarbocyanine hydroxide at a rate of $2.5\times10^{-4}$ mol per mol of silver halide to make said emulsion green-sensitive. To this photographic emulsion, a dispersion solution in which a magenta coupler, 1-(2,4,6-trichlorophenyl)-3-[3-(9-octadecenyl)-succinimidanilino]-5-pyrazolone had been protect-dispersed according to an ordinary manner was added at a rate of 0.20 mol of the coupler per mol of silver halide. The resulting photographic emulsion was then applied at a rate of 4.5 mg of silver halide calculated in silver and 42 mg of gelatin per 100 $cm^2$.

Layer 4: Inter layer

A gelatin solution was applied at a rate of 10 mg of gelatin/100 $cm^2$.

Layer 5: Red-sensitive photographic emulsion layer

A silver chlorobromide emulsion containing 25 mol% of silver chloride and having 0.2–0.4μ of particle diameter was subjected to an optical sensitization by adding thereto as a sensitizing dye, 2-[3-ethyl-5-(1-ethyl-4(1H)-quinolidene)-ethylidene-4-oxothiazolidin-2-ylidene]methyl-3-ethylbenzoxazoliumethylsulfate at the rate of $2.5\times10^{-4}$ mol per mol of silver halide to make said emulsion red-sensitive. To this photographic emulsion, a dispersion solution in which a cyan coupler, 2,4-dichloro-3-methyl-6-(2,4-di-tert-amylphenoxyacetamido)phenol had been protect-dispersed according to an ordinary manner was added at a rate of 0.35 mol of the coupler per mol of silver halide. The resulting photographic emulsion was then applied at a rate of 2.0 mg of silver halide calculated in silver and 18.5 mg of gelatin per 100 $cm^2$.

Layer 6: Protective layer

A gelatin solution was applied at a rate of 10 mg of gelatin/100 $cm^2$ to each sample.

With regard to each of the samples thus obtained, the test on the same day, the high humidity test and the high temperature test were carried out similarly as in previous Examples and white stepwise exposure was given to each sample. Thereafter, the following development was carried out according to an order of succession as given below:

| Processing Step (31° C.) | Processing Time (min.) |
|---|---|
| Color development | 3 |
| Bleaching and fixing | 1 |
| Washing with water | 2 |
| Stabilization | 1 |
| Washing with water | 10 |
| Drying (below 95° C.) | |

The composition of the processing solution used in each of the above steps is as follows:

| | |
|---|---|
| Color development: | |
| N-ethyl-N-β-methanesulfonamidoethyl-3-methyl-4-aminoaniline sulfate | 4.0 g |
| Hydroxylamine | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glyol (average polymerization degree 400) | 3.0 ml |
| Water to make up 1 liter is added and pH is adjusted to 10.0 with sodium hydroxide. | |
| Bleaching and fixing: | |
| Ethylenediaminetetraacetic acid iron sodium salt | 60.0 g |
| Ammonium thiosulfate | 100.0 g |
| Sodium bisulfite | 10.0 g |
| Sodium metabisulfite | 3.0 g |
| Water to make up 1 liter is added and pH is adjusted to 6.6 with aqueous ammonia. | |
| Stabilizing: | |
| Succinic acid | 10.0 g |
| Formalin (37% aqueous solution) | 15.0 ml |
| After adding of 800 ml of water and adjustment of pH to 3.9, further water being added to make up 1 liter. | |

With regard to each sample thus processed, the reflection density of blue light was measured by mean of PDA-60 type photoelectric densitometer (manufactured by Konishiroku Photo Industry Co., Ltd.), and further the speed and fog were determined. Results obtained are shown in Table 9.

TABLE 9

| Sample | Same day test | | High humidity test | | High temperature test | |
|---|---|---|---|---|---|---|
| No. | Speed | Fog | Speed | Fog | Speed | Fog |
| 1 | 100 | 0.01 | 94 | 0.07 | 101 | 0.03 |
| 2 | 101 | 0.01 | 96 | 0.07 | 99 | 0.03 |
| 3 | 98 | 0.01 | 93 | 0.06 | 97 | 0.03 |
| 4 | 105 | 0.00 | 104 | 0.02 | 104 | 0.01 |
| 5 | 103 | 0.00 | 102 | 0.02 | 102 | 0.01 |

As shown by the above results, samples 4 and 5 to which the present invention was applied show higher speed and less fog than the comparative samples in the test on the same day, and further during the storage at higher humidity and higher temperature, said samples 4 and 5 cause no decrease in the speed and less formation of fog, providing thereby extremely stabilized photographic efficiency.

What we claim is:

1. A photographic material having a light sensitive silver halide emulsion layer coated on a support which contains a compound of the following general formula I and a compound of the following general formula II:

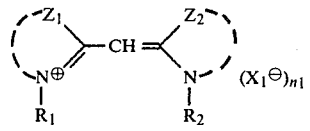

wherein $Z_1$ represents a group of non-metal atoms required to complete a 5 membered heterocyclic residue containing an oxygen atom; $Z_2$ represents a group of non-metal atoms required to complete a 5 membered heterocyclic residue containing an oxygen, sulfur or selenium atom; $R_1$ and $R_2$ each represent aliphatic groups, at least one of them containing a sulfo or carboxyl group; $X_1^{\ominus}$ represents an acid anion and $n_1$ represents a number of 0 or 1, said $n_1$ being 0 when an intramolecular salt is formed;

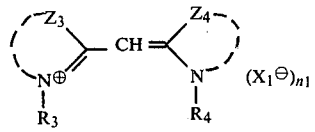

wherein $Z_3$ and $Z_4$ each represent groups of non-metal atom required for forming a thiazole, benzothiazole, naphthothiazole, selenazole, benzoselenazole, naphthoselenazole nucleus, $R_3$ and $R_4$ each represent aliphatic groups, at least one of them containing a sulfo or carboxyl group, $R_2^{\ominus}$ represents an anion and $n_2$ represents a number of 0 or 1, said $n_2$ being 0 when an intramolecular salt is formed.

2. A photographic material, according to claim 1, which comprises a compound of the following general formula III:

General formula III

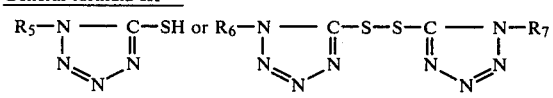

wherein $R_5$, $R_6$ and $R_7$ each represent a hydrogen atom, an alkyl group, alkenyl, aryl or aralkyl group.

3. A photographic material according to claim 1 wherein $Z_1$ and $Z_2$ each represent a benzoxazole or naphthoxazole, nucleus and $Z_3$ and $Z_4$ each represent a benzothiazole, naphthothiazole, benzoselenazole or naphthoselenazole nucleus.

4. A photographic material according to claim 3 wherein the nuclei includes at least one of an alkyl, alkoxy, halogen, carboxylalkyl, trifluoromethyl, hydroxy or aryl group as the substituent or substituents therein.

5. A photographic material according to claim 1 wherein $R_1$, $R_2$, $R_3$ and $R_4$ each represent an alkylsulfo group.

6. A photographic material according to claim 1 wherein the photographic material is a color photographic material.

7. A photographic material according to claim 2 wherein the photographic material is a color photographic material.

* * * * *